US009216359B2

(12) United States Patent
Gilbert

(10) Patent No.: US 9,216,359 B2
(45) **Date of Patent: *Dec. 22, 2015**

(54) CHILD SUPPORT REPOSITIONING MECHANISM

(71) Applicant: David Gilbert, Cumming, GA (US)

(72) Inventor: David Gilbert, Cumming, GA (US)

(73) Assignee: Kids II, Inc., Atlanta, GA (US)

( * ) Notice: Subject to any disclaimer, the term of this patent is extended or adjusted under 35 U.S.C. 154(b) by 24 days.

This patent is subject to a terminal disclaimer.

(21) Appl. No.: 14/071,415

(22) Filed: Nov. 4, 2013

(65) Prior Publication Data

US 2014/0057732 A1 Feb. 27, 2014

Related U.S. Application Data

(63) Continuation of application No. 13/085,035, filed on Apr. 12, 2011, now Pat. No. 8,602,903.

(51) Int. Cl.

| | |
|---|---|
| ***A63G 9/16*** | (2006.01) |
| ***A63G 13/02*** | (2006.01) |
| ***A47D 13/10*** | (2006.01) |
| *A47D 9/00* | (2006.01) |

(52) U.S. Cl.

CPC ..... *A63G 13/02* (2013.01); *A47D 13/105* (2013.01)

(58) Field of Classification Search

CPC ..... A63G 9/00; A63G 9/16; A63G 13/00; A63G 13/02; A63G 27/00; A63G 27/02; A47D 9/00; A47D 9/02; A47D 13/00; A47D 13/105

USPC ..... 472/118–125; 297/273, 274, 283, 130, 297/256.12, 256.16, 344.21, 344.22

See application file for complete search history.

(56) References Cited

U.S. PATENT DOCUMENTS

| | | | |
|---|---|---|---|
| 2,124,501 | A | 7/1938 | Willoughby |
| 2,148,187 | A | 2/1939 | Burnham |
| 2,154,600 | A | 4/1939 | Bell |
| 2,372,495 | A | 7/1944 | Horner et al. |
| 2,446,906 | A | 8/1948 | Buker |
| 2,472,349 | A | 6/1949 | Smith |

(Continued)

FOREIGN PATENT DOCUMENTS

| | | | |
|---|---|---|---|
| CN | 2840819 | Y | 11/2006 |
| CN | 201008471 | Y | 1/2008 |

(Continued)

OTHER PUBLICATIONS

Instruction Manual for Bright Starts Cradle & Sway Swing, published in Feb. 2010.

(Continued)

*Primary Examiner* — Kien Nguyen
(74) *Attorney, Agent, or Firm* — Alston & Bird LLP

(57) ABSTRACT

Various embodiments of the present invention are directed to a repositioning mechanism adapted for use with a swing and configured to permit a child support to be secured a forward-facing position and one or more side-facing positions. In particular, the repositioning mechanism is configured to maintain the child support's center of gravity in the same lateral position in both the forward-facing and side-facing positions, as well as to effect longitudinal movement ensuring the child support remains longitudinally proximate to its point or points of support, such as a point of rotation.

12 Claims, 6 Drawing Sheets

(56) References Cited

U.S. PATENT DOCUMENTS

| | | | |
|---|---|---|---|
| 2,869,615 | A | 1/1959 | Austin |
| 3,013,837 | A | 7/1960 | Pessl et al. |
| 3,066,979 | A | 12/1962 | Pitts et al. |
| 4,417,715 | A | 11/1983 | Edwards |
| 5,562,548 | A | 10/1996 | Pinch et al. |
| 5,846,136 | A | 12/1998 | Wu |
| 6,027,170 | A | 2/2000 | Benz et al. |
| 6,241,314 | B1 | 6/2001 | Pufall |
| 6,938,954 | B1 | 9/2005 | Hendren et al. |
| 7,219,961 | B2 | 5/2007 | Priepke et al. |
| 7,434,863 | B2 | 10/2008 | Hamazaki et al. |
| 7,472,958 | B2 | 1/2009 | Sano et al. |
| 7,753,444 | B2 | 7/2010 | Vallentin |
| 7,789,762 | B2 | 9/2010 | Greger et al. |
| 7,845,728 | B2 | 12/2010 | Chen et al. |
| 8,308,578 | B2 | 11/2012 | Gilbert et al. |
| 8,313,390 | B2 | 11/2012 | Lu |
| 8,602,903 | B2 | 12/2013 | Gilbert |
| 2006/0270480 | A1 | 11/2006 | Chen |
| 2008/0020854 | A1 | 1/2008 | Tuckey et al. |
| 2009/0127908 | A1 | 5/2009 | Kucharski et al. |
| 2010/0052392 | A1 | 3/2010 | Lung et al. |

FOREIGN PATENT DOCUMENTS

| | | | |
|---|---|---|---|
| CN | 101731883 | A | 6/2010 |
| CN | 101889794 | A | 11/2010 |
| CN | 202681300 | U | 1/2013 |

OTHER PUBLICATIONS

State Intellectual Property Office of the P.R.C., Office Action and Search Report (SR) for Application No. CN 201210106856.8, Jul. 21, 2014, 9 pages, China.

CHILD SUPPORT REPOSITIONING MECHANISM

CROSS-REFERENCE TO RELATED APPLICATIONS

This patent application is a continuation of U.S. Nonprovisional application Ser. No. 13/085,035, filed Apr. 12, 2011, which is herein incorporated by reference in its entirety.

BACKGROUND OF THE INVENTION

1. Field of the Invention

Various embodiments of the present invention described herein generally relate to repositioning apparatuses and methods for a support device, such as a child support for a children's swing.

2. Description of Related Art

Children's swings typically include a child support, such as a child seat or fabric support, suspended by one or more swings arms and configured to reciprocate along a swing path. In certain swings, the child support is configured to be adjusted between a first orientation, in which a child positioned in the child support faces the direction of the swing, and a second orientation, in which a child positioned in the child support faces a direction perpendicular to the swing path.

Current art suggests that it is desirable to configure such swings to maintain the position of the child support's center of gravity in the same position relative to the swing's structure in both the forward-facing and side-facing positions. For example, U.S. Patent Application Publication 2008/0020854 describes an infant swing having a pair of hanger arms supporting a children's seat that is adjustable between a back-and-forth configuration and a sideways configuration. The seat is connected to a swivel mechanism having an elliptical retainer that causes the children's seat to shift laterally as the seat is repositioned between the back-and-forth and sideways configurations. This lateral shift is intended to maintain the seat's center of gravity in a single desired location proximate to the swing's center line.

However, certain children's swings include a child support suspended by at least one swing arm that applies a moment transverse to its swing path at its point of rotation. In such swings, the moment applied by the swing arm increases the energy required to drive the swing arm along its swing path and imparts stresses on the swing structure that increase the resiliency required of materials used to construct the swing. Accordingly, as a child support is adjusted between various orientations, it would be advantageous to reduce the moment applied by one or more swing arms while also maintaining the lateral balance of the child support.

However, the repositioning mechanisms disclosed in current art—such as U.S. Publication 2008/0020854—are not configured for repositioning a child support in a manner that reduces the moment applied by a swing arm suspending the child support. Accordingly, there is a need in the art for a child support repositioning mechanism configured to maintain the lateral balance of a swing's child support as it is adjusted between various orientations while also reducing the moment applied by one or more swing arms. In addition, there is a need for such a mechanism to be compact and adapted to fit within a small space.

BRIEF SUMMARY OF THE INVENTION

Various embodiments of the present invention are directed to a children's swing having a child support configured to move between at least two orientations. In various embodiments, the children's swing comprises a swing frame; at least one swing arm, where a rotating end of the swing arm is rotatably connected to the swing frame at a rotation point and the swing arm is configured to reciprocate about the rotation point along a swing path; a child support configured for receiving and supporting a child; and a repositioning mechanism operatively connected to the swing arm and the child support. The repositioning mechanism is configured to selectively secure the child support in at least a first orientation and a second orientation. When positioned in the first orientation and at rest, the child support faces a direction substantially perpendicular to the direction of the swing path, a target location on the child support is positioned in alignment with a vertical plane that is perpendicular to the swing path and that extends through the rotation point, and the target location on the child support is positioned at a first longitudinal distance from the rotation point. When positioned in the second orientation and at rest, the child support faces a direction substantially parallel to the direction of the swing path, the target location on the child support is positioned in alignment with the vertical plane, and the target location on the child support is positioned at a second longitudinal distance from the pivot point, the second longitudinal distance being less than the first longitudinal distance.

In addition, various other embodiments of the present invention are directed to an adjustable child support apparatus. In various embodiments, the adjustable child support apparatus comprises a child support configured for receiving and supporting a child, the child support including at least two channel engaging members extending downwardly from the child support; and a repositioning mechanism operatively connected to the child support, the repositioning mechanism comprising a housing defining at least two intersecting channels dimensioned to receive the channel engaging members. The channels and the channel engaging members are configured for guiding the child support for movement between a forward-facing orientation and at least one side-facing orientation. In addition, the lateral position of a target location on the child support in the forward-facing orientation is aligned with the lateral position of the target location in the side-facing orientation, and the longitudinal position of the target location is different in the forward-facing orientation and the side-facing orientation.

BRIEF DESCRIPTION OF THE SEVERAL VIEWS OF THE DRAWINGS

Reference will now be made to the accompanying drawings, which are not necessarily drawn to scale, and wherein.

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Various embodiments of the present invention are directed to a repositioning mechanism adapted for use with a swing and configured to permit a child support to be secured in a forward-facing orientation and one or more side-facing orientations. In particular, the repositioning mechanism is configured to rotate the child support such that lateral and longitudinal movement of the child support is controlled as it is rotated between the forward-facing orientation and a side-facing orientation. As such, the repositioning mechanism may be configured to maintain the child support's center of gravity in the same lateral position in both the forward-facing and side-facing orientations, as well as to effect longitudinal movement ensuring the child support remains longitudinally proximate to its point (or points) of support (e.g., the rotation point of a swing arm suspending the child support).

Figure 1:
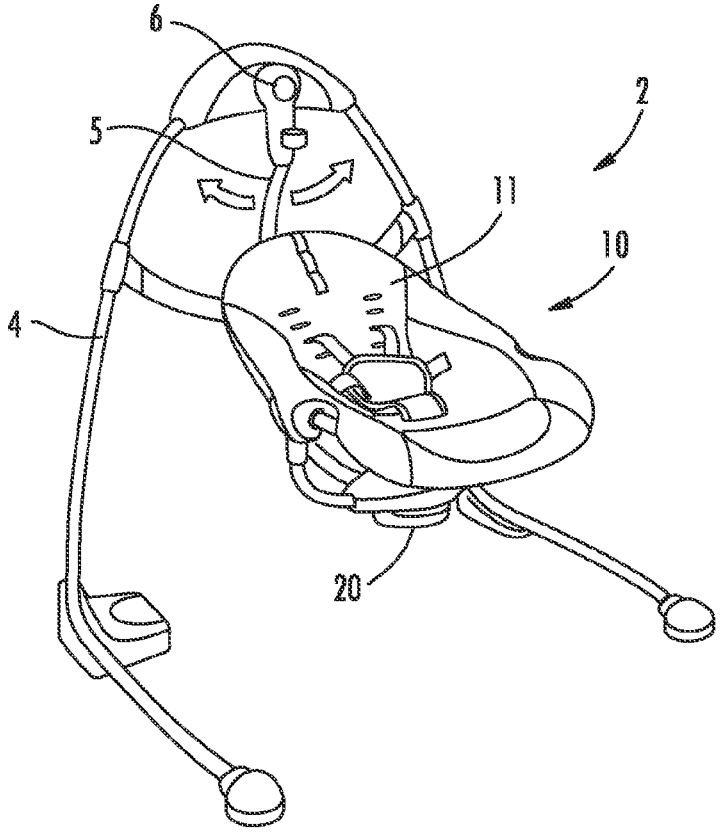
FIG. 1 shows a perspective view of a children's swing according to one embodiment of the present invention.

FIG. 1 illustrates a children's swing 2 having a repositioning mechanism 20 according to one embodiment of the present invention. In the illustrated embodiment, the swing 2 comprises a swing frame 4, a swing arm 5, and a child support 10. An upper portion of the swing arm 5 is rotatably connected to the swing frame 4 at a rotation point 6. A lower portion of the swing arm 5 extends outwardly from its upper portion and beneath the child support 10. The swing's repositioning mechanism 20 is affixed to the lower portion of the swing arm 5 and, as described in greater detail herein, is operatively connected to the child support 10. As shown in FIG. 1, the swing arm 5 suspends the child support 10 above a support surface (e.g., a floor) and is configured to rotate about the rotation point 6 in order to oscillate the child support 10 along a swing path (e.g., an arcuate swing path), which is indicated generally by the directional arrows in FIG. 1. In various other embodiments, the swing 2 may comprise one or more additional swing arms configured to rotate about the rotation point 6.

Figure 2:
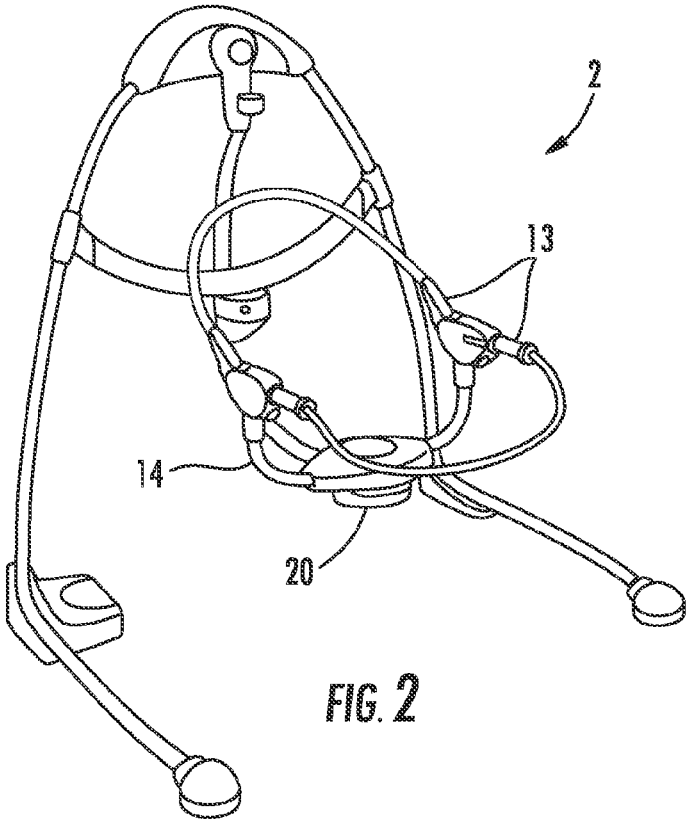
FIG. 2 shows a perspective view of the children's swing of FIG. 1 with a cover removed from the child support according to one embodiment.

In the illustrated embodiment, the child support 10 comprises a support frame 13, 14 (visible in FIG. 2) and a fabric cover 11. As shown in FIG. 1, the cover 11 provides a support surface for a child when attached to the support frame 13, 14. FIG. 2 illustrates the swing 2 with the child support's cover 11 removed. As shown in FIG. 2, the support frame comprises an upper portion 13 configured to receive the cover 11 and a lower crossbar 14 affixed to the repositioning mechanism 20. In various other embodiments, the child support may comprise a frame with another suitable cover (e.g., a removable or non-removable cover made from a flexible or resilient material), a non-removable support formed from a rigid shell, a removable child seat having a rigid shell with integrated padding, a platform support (e.g., a bench and seat back), a suspended sling support (e.g., a flexible sling with leg openings), or other suitable child supporting device.

Figure 3:
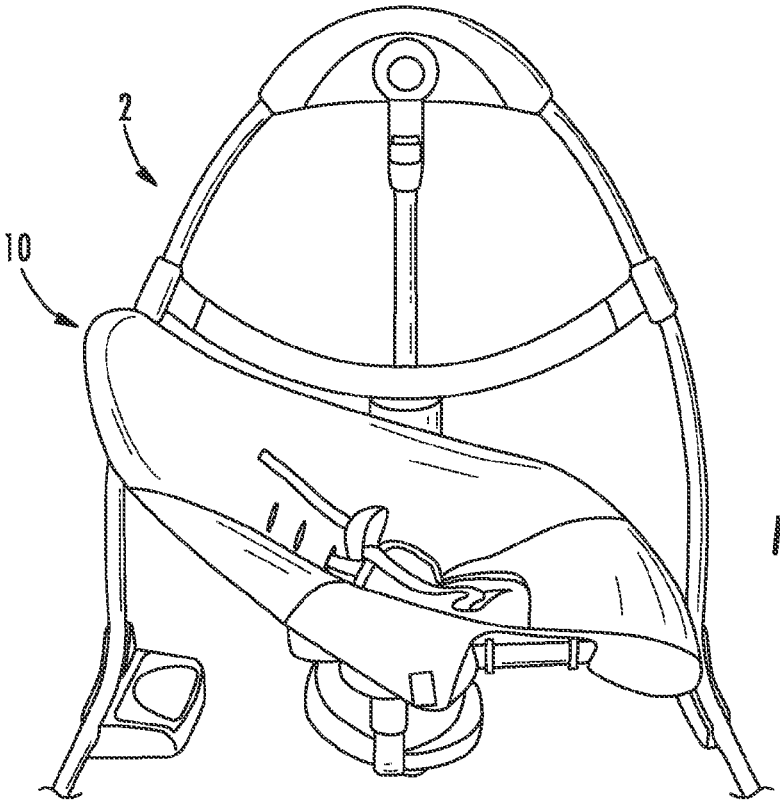
FIG. 3 shows a front view of a children's swing having a child support in a left-side-facing orientation according to one embodiment.
Figure 4:
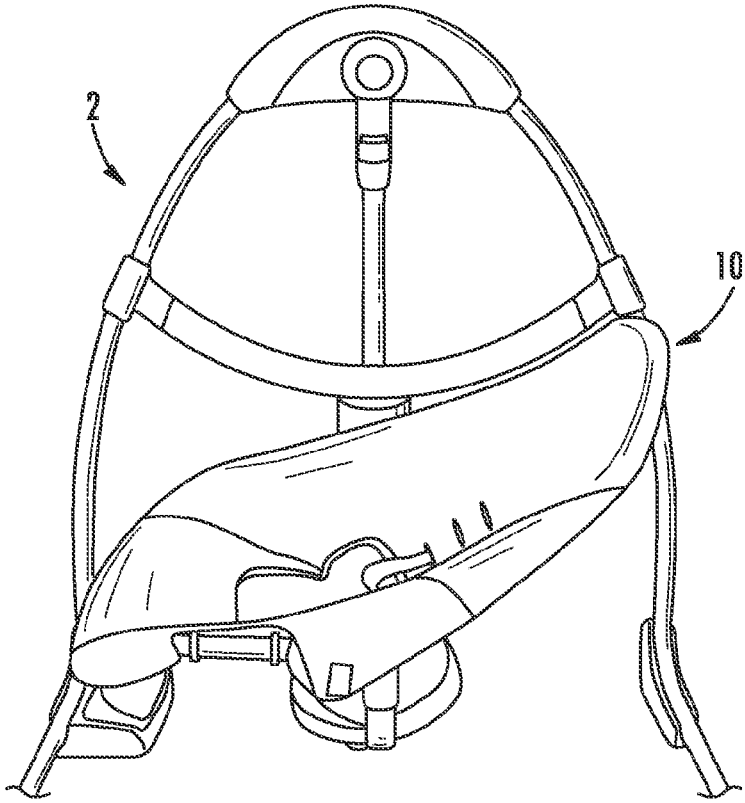
FIG. 4 shows a front view of a children's swing having a child support in a right-side-facing orientation according to one embodiment.

As described in greater detail herein, the repositioning mechanism 20 permits the crossbar 14—and thereby the entire child support 10—to move between a forward-facing orientation, a left-side-facing orientation, and a right-side-facing orientation. In the forward-facing orientation, shown in FIGS. 1 and 2, a child positioned in the child support 10 will face a direction substantially perpendicular to the swing path. In the left-side orientation (shown in FIG. 3) and the right-side orientation (shown in FIG. 4), a child positioned in the child support 10 will face a direction substantially parallel to the swing path. As used herein, the term "longitudinal" shall refer to a horizontal direction that is perpendicular to the swing path of the swing arm 5. In addition, the term "lateral" shall refer to a horizontal direction that is parallel to the swing path of the swing arm 5.

As will be appreciated from FIGS. 1-4, the length of the child support 10 is greater than its width. As a result, the geometry of the swing frame 4 and swing arm 5 permits the child support's center of gravity to be located longitudinally closer to the rotation point 6 when the child support 10 is in the left-side-facing or right-side-facing orientation than when the child support 10 is in the forward-facing orientation. Accordingly, in various embodiments, the repositioning mechanism 20 is configured to constrain the movement of the child support 10 such that a target location on the child support 10 remains in a fixed lateral position in the forward-facing, left-side-facing, and right-side-facing orientations, but moves longitudinally between the forward-facing orientation and either of the right-side-facing and left-side-facing orientations.

For example, in one embodiment, the target location may be an expected location of the child support's center of gravity when a child is positioned in the child support 10. The child support's true center of gravity at any given time may vary depending on the weight and position of any child positioned in the child support 10, as well as the weight and position of any accessories (e.g., a bottle or children's toy). Accordingly, the target location may be an approximation of the child support's center of gravity when a child of average size is seated in an expected position in the child support 10. However, as will be appreciated from the description herein, the target location on the child support 10 may be defined according to the size, weight, and position of any expected occupants of the child support. Thus, in some cases, the target location of a child support 10 configured for young children (e.g., infants) may be different from the target location of a child support 10 configured for older children. In other embodiments, the target location may be the location of the child support's center of gravity, or an approximated location of the child support's center of gravity, without a child positioned therein.

Figure 5:
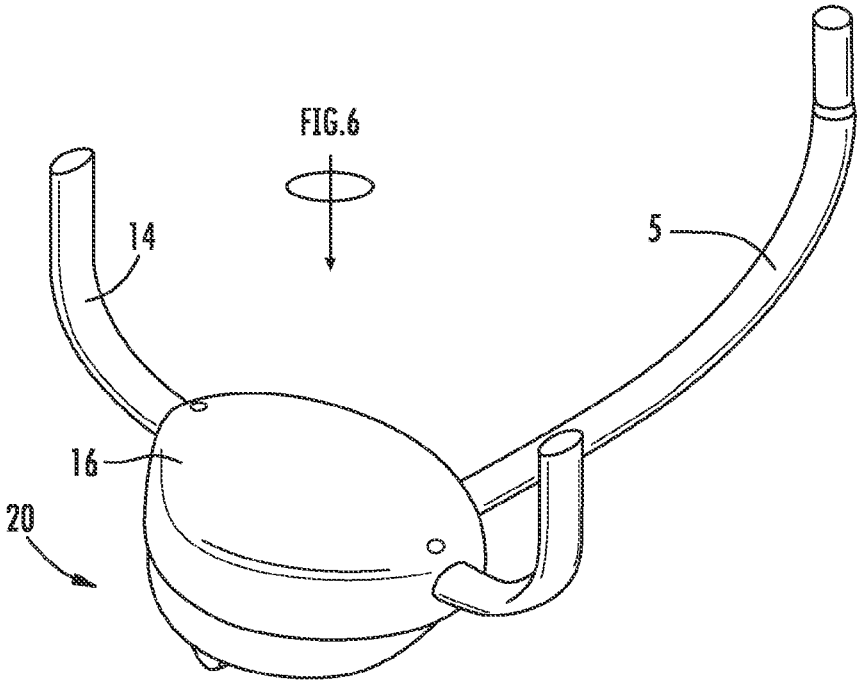
FIG. 5 shows a perspective view of a crossbar and repositioning mechanism assembly according to one embodiment.

As shown in FIG. 5, the support frame's crossbar 14 is positioned on a top surface of the repositioning mechanism 20. In the illustrated embodiment, a shell 16 is secured around a medial region of the crossbar 14 (e.g., to shield components of the repositioning mechanism 20 from damage and/or interference by a user). The shell 16 includes a lower surface positioned slightly above the top surface of the repositioning mechanism 20 such that the shell 16 is free to move with the crossbar 14 as the child support 10 is moved between its forward-facing and side-facing positions.

Figure 6:
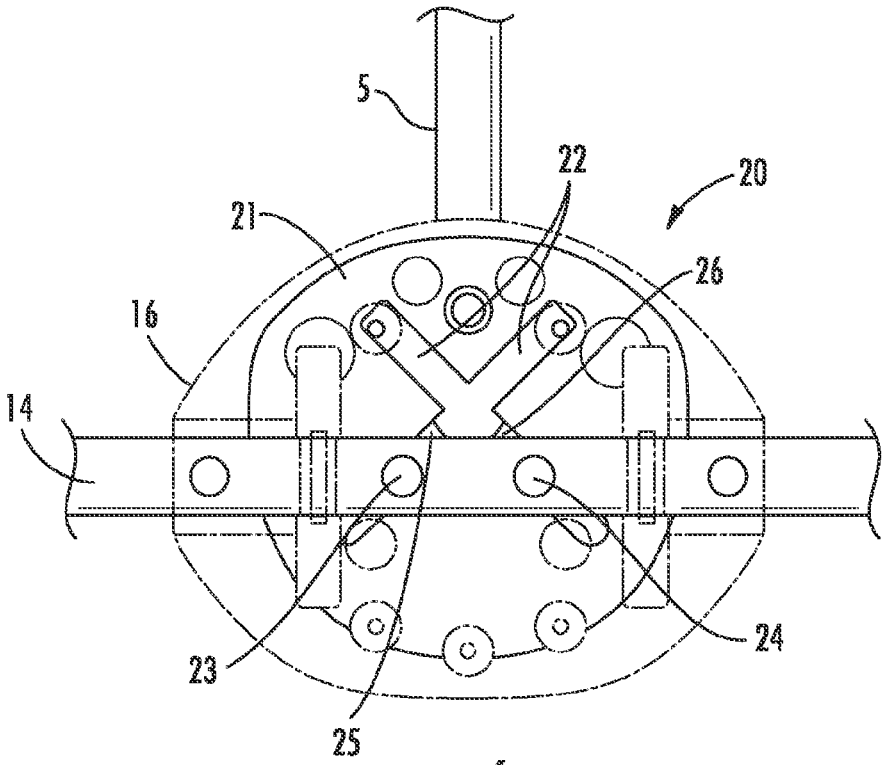
FIG. 6 shows a top plan view of the crossbar and repositioning mechanism assembly of FIG. 5.

FIG. 6 provides a more detailed top view of the repositioning mechanism 20 as viewed through the shell 16. In the illustrated embodiment, the repositioning mechanism 20 comprises a housing 21 defining a pair of channels 22 oriented perpendicular to one another and forming an X-shaped opening on the housing's top surface. The housing 21 further defines an interior space containing a pair of guide members (25, 26 in FIGS. 4-8), each being configured to move along the longitudinal axis of one of the channels 22. The guide members 25, 26 are connected to the crossbar 14 with pins 23, 24, which permit the crossbar 14—and thereby the child support 10—to rotate in relation to the guide members 25, 26 as they move along the axes of the channels 22. As a result, the crossbar 14 forms a linkage between the guide member 25 and the guide member 26 that constrains the movement of the child support 10. In addition, the pins 23, 24 provide two points of connection between the crossbar 14 and repositioning mechanism 20. Accordingly, if one of the pins 23, 24 fails, the other of the pins 23, 24 will keep the crossbar 14 secured to the repositioning mechanism 20, thereby preventing child support 10 from becoming disengaged from the swing 2.

According to various embodiments, each guide member 25, 26 is restricted to movement along only one of the channels 22. For example, in one embodiment, the guide members 25, 26 are configured to guide the movement of the crossbar 14 by moving along tracks that are defined within the housing 21 and aligned with the channels 22. In such embodiments, the guide members 25, 26 may be dimensioned such that their length is greater than the width of the tracks, thereby preventing the guide members 25, 26 from turning and engaging another track (e.g., at a point where the tracks intersect). In other embodiments, the pins 23, 24 are configured to extend into the channels 22 and connect with the guide members 25, 26; the interaction between the pins 23, 24 and channels 22 restricting the movement of the guide members 25, 26 to the channels' longitudinal axes. In such embodiments, the pins 23, 24 may have a cross-section at the point where they engage the channels 22 that permits each of the pins 23, 24 to move along only one of the channels 22 and prevents the pins 23, 24 from engaging the other of the channels 22. For example, in one embodiment, the pins 23, 24 may have a rectangular cross-section having a width that is slightly less than the width of the channels 22 and having a length greater than the width of the channels 22. In other embodiments, the pins 23, 24 extend into the channels 22 and are each configured to move along one of the channels 22, thereby restricting the movement of the crossbar 14 without the use of separate guide members.

Figure 9:
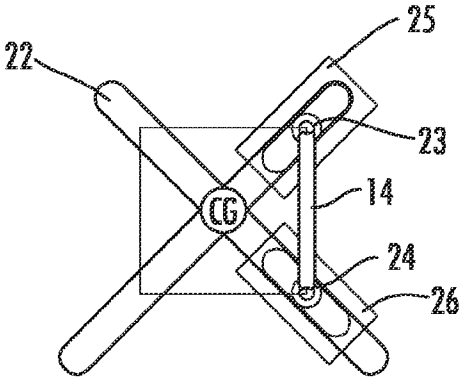
FIG. 9 shows a top view diagram of a repositioning mechanism and crossbar in a right-side-facing orientation according to one embodiment.
Figure 8:
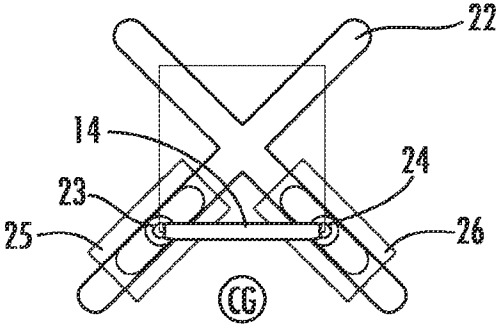
FIG. 8 shows a top view diagram of a repositioning mechanism and crossbar in a forward-facing orientation according to one embodiment.
Figure 7:
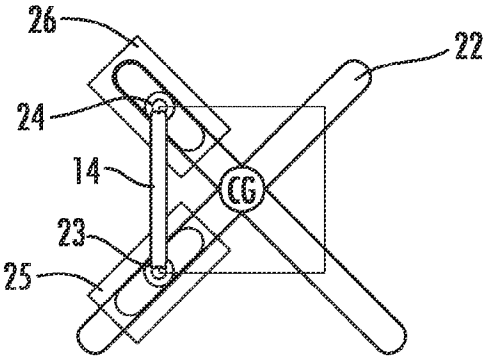
FIG. 7 shows a top view diagram of a repositioning mechanism and crossbar in a left-side-facing orientation according to one embodiment.
Figure 12:
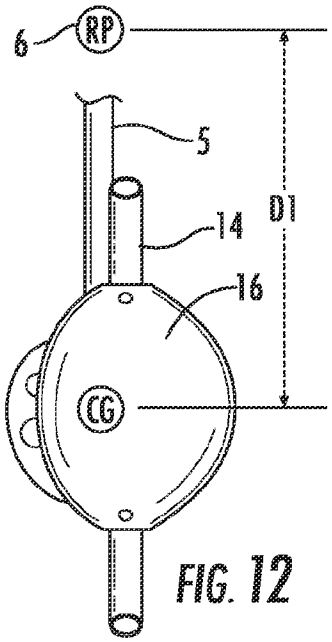
FIG. 12 shows a top view of a swing arm, crossbar, and repositioning mechanism in a right-side-facing orientation in relation to a child support center of gravity and swing rotation point according to one embodiment.
Figure 11:
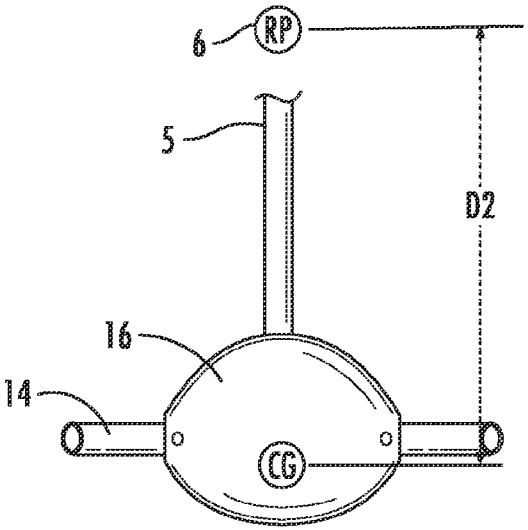
FIG. 11 shows a top view of a swing arm, crossbar, and repositioning mechanism in a forward-facing orientation in relation to a child support center of gravity and swing rotation point according to one embodiment.
Figure 10:
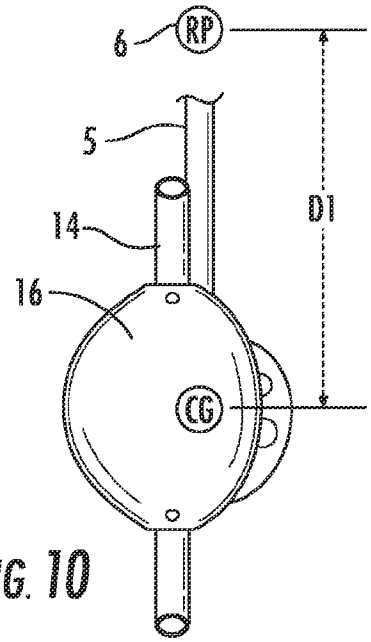
FIG. 10 shows a top view of a swing arm, crossbar, and repositioning mechanism in a left-side-facing orientation in relation to a child support center of gravity and swing rotation point according to one embodiment.

FIGS. 7-9 illustrate the positioning of the guide members 25, 26, pins 23, 24, and crossbar 14 as the child support 10 is rotated between its forward-facing, left-side-facing, and right-side-facing orientations according to one embodiment. FIGS. 10-12 illustrate the corresponding positioning of the crossbar 14 and shell 16 in relation to the swing arm 5. In each of FIGS. 7-12, the position of the child support's center of gravity in the illustrated embodiment is indicated by a "CG" emblem. Accordingly, the "CG" emblem represents one example of a target location on the child support 10.

FIG. 8 provides an overhead view showing the positioning of the guide members 25, 26 and crossbar 14 when the child support 10 is in the forward-facing orientation. FIG. 11 shows the corresponding position of the swing arm 5, shell 16, and crossbar 14 when the child support 10 is in the same forward-facing orientation, the swing arm 5 is at rest, and the swing frame 4 is on a level support surface (e.g., as shown in FIGS. 1 and 2). As shown in FIG. 8, in the forward-facing orientation, the crossbar 14 is laterally oriented and the guide members 25, 26 are positioned in the forward areas of their respective channels 22. As a result, the child support's center of gravity ("CG") is located—longitudinally—in front of the crossbar 14. As shown in FIG. 11, the child support's center of gravity is also laterally aligned with the swing arm 5 and, thus, the rotation point 6 (the position of which is indicated by an "RP" emblem in FIGS. 10-12). Accordingly, in the forward-facing orientation shown in FIGS. 8 and 11, the child support's center of gravity would lie in alignment with a vertical plane that is perpendicular to the swing path of the swing arm 5 and that extends through the rotation point 6. In addition, as shown in FIG. 11, the child support's center of gravity is positioned at a longitudinal distance "D2" from the rotation point.

FIG. 7 provides an overhead view showing the positioning of the guide members 25, 26 and crossbar 14 when the child support 10 is in the left-side-facing orientation. FIG. 10 shows the corresponding position of the swing arm 5, shell 16, and crossbar 14 when the child support 10 is in the same left-side-facing orientation, the swing arm 5 is at rest, and the swing frame 4 is on a level support surface. To guide the child support 10 from the forward-facing orientation to the left-side-facing orientation, the guide member 26 moves from the forward area of its respective channel 22 to a rearward area of its channel 22. As the guide member 26 moves along this path, the crossbar 14 rotates about the pin 23 and causes the guide member 25 to move rearward and forward along its respective channel 22. As shown in FIG. 7, once in the left-side-facing orientation, the crossbar 14 is longitudinally oriented—approximately 90 degrees from its position in the forward-facing orientation—and the guide members 25, 26 are positioned in the forward and rearward areas of the channels 22.

As a result, the child support's center of gravity ("CG") is shifted longitudinally toward the swing arm 5 and rotation point 6.

As shown in FIG. 10, the child support's center of gravity is positioned at a longitudinal distance "D1" from the rotation point 6 when in the left-side-facing orientation. As the child support 10 moves longitudinally toward the rotation point 6 when adjusted from the forward-facing orientation to the left-side-facing orientation, the distance "D1" is less than the distance "D2." However, as shown in FIG. 10, the child support's center of gravity remains laterally aligned with the swing arm 5 and, thus, the rotation point 6. Accordingly, in the left-side-facing orientation shown in FIGS. 7 and 10, the child support's center of gravity remains in alignment with a vertical plane that is perpendicular to the swing path of the swing arm 5 and that extends through the rotation point 6.

FIG. 9 provides an overhead view showing the positioning of the guide members 25, 26 and crossbar 14 when the child support 10 is in the right-side-facing orientation. FIG. 12 shows the corresponding position of the swing arm 5, shell 16, and crossbar 14 when the child support 10 is in the same right-side-facing orientation, the swing arm 5 is at rest, and the swing frame 4 is on a level support surface. To guide the child support 10 from the forward-facing orientation to the right-side-facing orientation, the guide member 25 moves from the forward area of its respective channel 22 to a rearward area of its channel 22. As the guide member 25 moves along this path, the crossbar 14 rotates about the pin 24 and causes the guide member 26 to move rearward and forward along its respective channel 22. As shown in FIG. 12, once in the right-side-facing orientation, the crossbar 14 is longitudinally oriented—approximately 90 degrees from its position in the forward-facing orientation—and the guide members 25, 26 are positioned in the forward and rearward areas of the channels 22. As a result, the child support's center of gravity ("CG") is shifted longitudinally toward the swing arm 5 and rotation point 6.

As shown in FIG. 12, the child support's center of gravity is positioned at a distance "D1" from the rotation point 6 when in the right-side-facing orientation. In the illustrated embodiment, this is the same distance from the rotation point 6 as in the left-side-facing orientation (shown in FIG. 10). Likewise, as the child support 10 moves longitudinally toward the rotation point 6 when adjusted from the forward-facing orientation to the right-side-facing orientation, the distance "D1" is less than the distance "D2." However, as shown in FIG. 12, the child support's center of gravity remains laterally aligned with the swing arm 5 and, thus, the rotation point 6. Accordingly, in the right-side-facing orientation shown in FIGS. 9 and 12, the child support's center of gravity remains in alignment with a vertical plane that is perpendicular to the swing path of the swing arm 5 and that extends through the rotation point 6.

By constraining the lateral position of the target location (e.g., the center of gravity in FIGS. 7-12), the repositioning mechanism 20 keeps the child support 10 balanced with respect to the swing arm 5 and rotation point 6. For example, in the illustrated embodiment, the child support 10 is centered over the swing arm 5 in each of the forward-facing, left-side-facing, and right-side-facing orientations. This relationship ensures that the child support's swing path will be properly centered in relation to the swing frame 4 and increases the stability of the child support 10 as it moves along its swing path, thereby reducing shaking and other effects of such instability. As described in greater detail herein, maintaining the lateral balance of the child support 10 may also improve the performance and efficiency of certain drive systems configured to drive the swing arm 5.

In addition, by permitting longitudinal movement of the target location, the child support 10 is moved—longitudinally—more proximate to the rotation point 6 and the moment applied by the swing arm 5 about the rotation point 6 is reduced. By shortening the longitudinal distance between the swing arm's point of rotation and the child support's center of gravity, the magnitude of the moment applied by the swing arm 5 is reduced along with the various stresses and strains imparted to the swing structure by the applied moment. By reducing these stresses and strains, the durability and reliability of the swing 2 is enhanced, the energy required to drive the swing arm 5 is reduced, and the resiliency required of materials used to construct the swing is reduced (thereby permitting use of lighter and/or less expensive materials). In addition, as can be seen from FIGS. 1-2 and 5-6, the configuration of the repositioning mechanism 20 is simple and compact, thereby reducing the weight applied to the swing arm 5 by the repositioning mechanism 20 and permitting the repositioning mechanism 20 to be easily incorporated into the swing's design.

According to various embodiments, the repositioning mechanism 20 may be configured to limit the rotational component of the child support's 10 movement to approximately 180 degrees (e.g., from a left-side-facing orientation, through a forward-facing orientation, and to a right-side-facing orientation). For example, in the illustrated embodiment of FIGS. 7-12, the length of the rearward portion of the channels 22 (e.g., the portion of each channel 22 rearward of the channels' point of intersection) is shorter than the length of the forward portion of the channels 22 (e.g., the portion of each channel 22 forward of channels' point of intersection). As a result, when the child support 10 is in the left-side-facing orientation of FIGS. 7 and 10, the guide member 26 is positioned at the end of the rearward portion of its respective channel 22. Accordingly, the guide member 26 is not permitted to move further rearward, thereby preventing the child support 10 from rotating past the left-side-facing orientation. Similarly, when the child support 10 is in the right-side-facing orientation of FIGS. 9 and 12, the guide member 25 is positioned at the end of the rearward portion of its respective channel 22. Accordingly, the guide member 25 is not permitted to move further rearward, thereby preventing the child support 10 from rotating past the right-side-facing orientation. Thus, in the illustrated embodiment of FIGS. 7-12, the repositioning mechanism 20 limits the rotational component of the child support's 10 movement to approximately 180 degrees between the left-side-facing orientation and the right-side-facing orientation. However, as will be appreciated from the description herein, various other embodiments of the repositioning mechanism 20 may be configured to permit child support 10 to rotate through a wider angle, such as 360 degrees (e.g., from a left-side-facing orientation, through a forward-facing orientation, through a right-side-facing orientation, through a rearward-facing orientation, and to the left-side-facing orientation).

In addition, in certain embodiments, the repositioning mechanism 20 may further include a locking mechanism for selectively locking the guide members 25, 26 and crossbar 14 in each of the positions shown in FIGS. 7-9. For example, in one embodiment, the repositioning mechanism's housing 21 includes spring-loaded members configured to engage depressions or detents located on the bottom side of the shell 16. The depressions and spring-loaded members may be positioned on the repositioning mechanism 20 such that they engage whenever the child support 10 is in the forward-facing, left-side-facing, or right-side-facing orientation. The resistance of the spring-loaded members may be such that, when engaged with the depressions, an incidental force applied to the child support 10 will not move the child support 10 from its current orientation, while a more deliberate force from a user will cause the spring-loaded members to disengage from the depressions and permit the user to move the child support 10 to another orientation. As will be appreciated description herein, various other locks, latches, and fastening devices may be used to selectively secure the child support 10 in a particular orientation.

As will be appreciated from the description herein, the structure and components of the repositioning mechanism 20 may be altered while still providing the advantageous characteristics of the child support's movement described above. For example, in one embodiment, the channels 22 may have an arcuate shape configured to permit the crossbar 14 to rotate about either of the pins 23, 24 and thereby permit the child support 10 to be positioned in the left-side-facing, forward-facing, and right-side-facing orientations of FIGS. 10-12.

In another embodiment, the repositioning mechanism 20 may be configured as shown in FIGS. 13-18. In the illustrated embodiment of FIGS. 13-18, the repositioning mechanism's channels 22 are configured such that one channel is orientated substantially perpendicular to the swing path of the swing arm 5 and the other channel is oriented substantially parallel to the swing path of the swing arm 5. Accordingly, in the embodiment of FIGS. 13-18, the child support's crossbar 14 is oriented longitudinally with respect to the child support 10 (e.g., such that the crossbar 14 is substantially perpendicular to the swing path of the swing arm 5 when the child support 10 is in its forward-facing orientation, rather than substantially parallel as shown in FIGS. 1 and 2).

Figure 14:
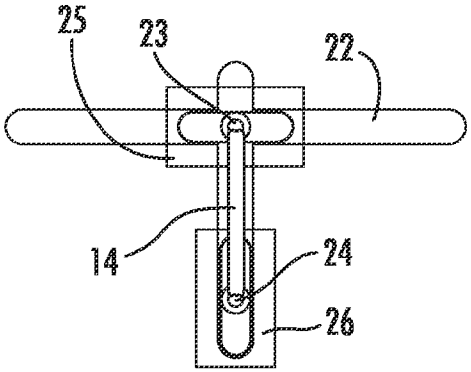
FIG. 14 shows a top view diagram of a repositioning mechanism and crossbar in a forward-facing orientation according to another embodiment.
Figure 17:
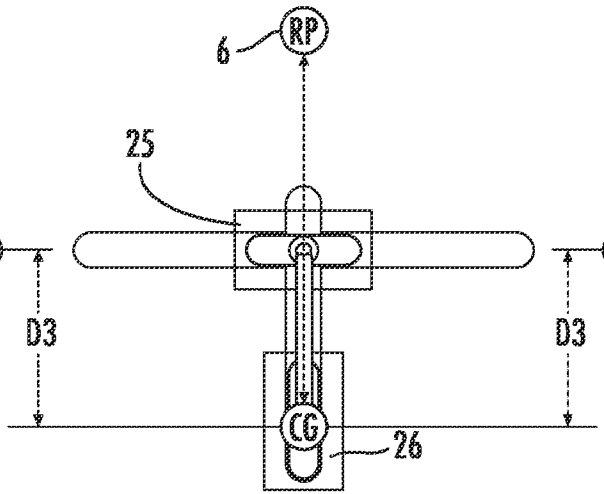
FIG. 17 shows a top view diagram of a repositioning mechanism and crossbar in a forward-facing orientation in relation to a child support center of gravity and swing rotation point according to another embodiment.

FIG. 14 provides an overhead view showing the positioning of the guide members 25, 26, their respective pins 23, 24, and the crossbar 14 when the child support 10 is in a forward-facing orientation. As shown in FIG. 14, in the forward-facing orientation, the crossbar 14 is longitudinally oriented as the guide member 25 is positioned proximate the center of its respective channel 22 and the guide member 26 is positioned proximate the forward end of its respective channel 22. FIG. 17 shows the positioning of the child support's center of gravity ("CG") in relation to the crossbar 14, guide members 25, 26, and the swing arm's rotation point ("RP") when the child support 10 is in the forward-facing orientation of FIG. 14. As shown in FIG. 17, the child support's center of gravity is aligned with the vertical axis of the pin 24 and thereby laterally aligned with the rotation point ("RP"). In other words, when at rest, the child support's center of gravity is aligned with a vertical plane that is perpendicular to the swing path of the swing arm 5 and that extends through the rotation point 6.

Figure 13:
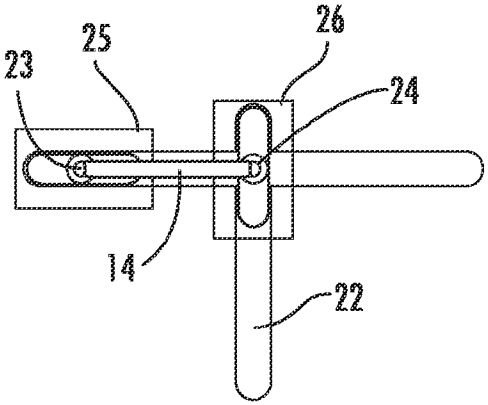
FIG. 13 shows a top view diagram of a repositioning mechanism and crossbar in a left-side-facing orientation according to another embodiment.

FIG. 13 provides an overhead view showing the positioning of the guide members 25, 26, their respective pins 23, 24, and the crossbar 14 when the child support 10 is in a left-side-facing orientation. To guide the child support 10 from the forward-facing orientation to the left-side-facing orientation, the guide member 25 moves from the center of its respective channel 22 to a position proximate the left end of its channel 22 (i.e., the "left end" of the channel 22 from the perspective of FIG. 13) and the guide member 26 moves from the forward area of its respective channel 22 to a position proximate a rearward end of its channel 22. As the guide members 25, 26 move along these paths, the crossbar 14 rotates into a lateral orientation substantially parallel to the swing path of the swing arm 5.

Figure 16:
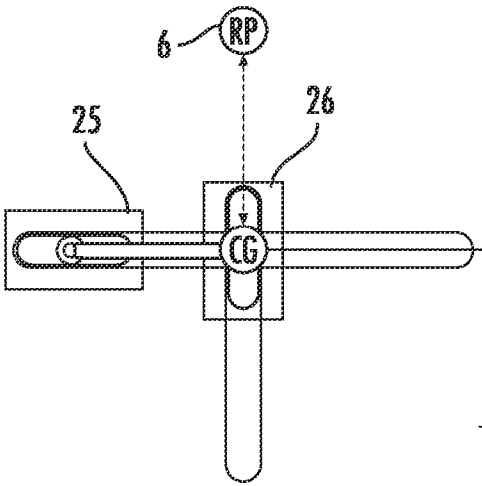
FIG. 16 shows a top view diagram of a repositioning mechanism and crossbar in a left-side-facing orientation in relation to a child support center of gravity and swing rotation point according to another embodiment.

FIG. 16 shows the positioning of the child support's center of gravity ("CG") in relation to the crossbar 14, guide members 25, 26, and the swing arm's rotation point ("RP") when the child support 10 is in the left-side-facing orientation of FIG. 13. As shown in FIG. 16, once in the left-side-facing orientation, the crossbar 14 is laterally oriented—approximately 90 degrees from its position in the forward-facing orientation—and the pin 24 of guide member 26 is moved longitudinally rearward. As a result, the child support's center of gravity ("CG") is moved—longitudinally—a distance "D3" toward the rotation point 6, while remaining laterally aligned with the rotation point 6. Accordingly, when at rest in the left-side-facing orientation shown in FIGS. 13 and 16, the child support's center of gravity remains in alignment with a vertical plane that is perpendicular to the swing path of the swing arm 5 and that extends through the rotation point 6.

Figure 15:
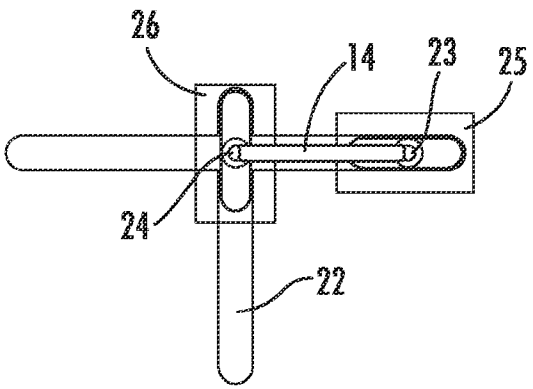
FIG. 15 shows a top view diagram of a repositioning mechanism and crossbar in a right-side-facing orientation according to another embodiment.

FIG. 15 provides an overhead view showing the positioning of the guide members 25, 26, their respective pins 23, 24, and the crossbar 14 when the child support 10 is in a right-side-facing orientation. To guide the child support 10 from the forward-facing orientation to the right-side-facing orientation, the guide member 25 moves from the center of its respective channel 22 to a position proximate the right end of its channel 22 (i.e., the "right end" of the channel 22 from the perspective of FIG. 15) and the guide member 26 moves from the forward area of its respective channel 22 to a position proximate a rearward end of its channel 22. As the guide members 25, 26 move along these paths, the crossbar 14 rotates into a lateral orientation substantially parallel to the swing path of the swing arm 5.

Figure 18:
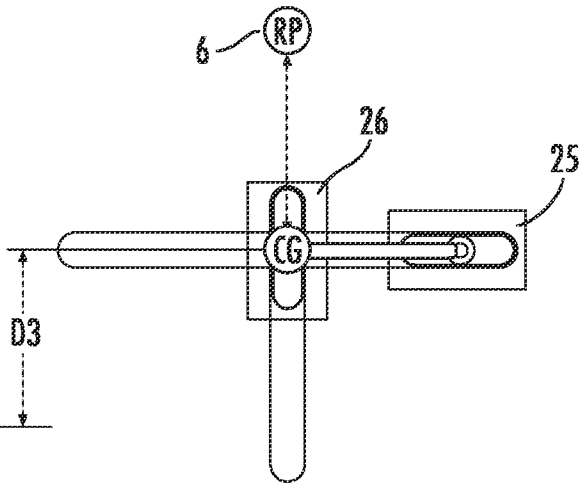
FIG. 18 shows a top view diagram of a repositioning mechanism and crossbar in a right-side-facing orientation in relation to a child support center of gravity and swing rotation point according to another embodiment.

FIG. 18 shows the positioning of the child support's center of gravity ("CG") in relation to the crossbar 14, guide members 25, 26, and the swing arm's rotation point ("RP") when the child support 10 is in the right-side-facing orientation of FIG. 15. As shown in FIG. 18, once in the right-side-facing orientation, the crossbar 14 is laterally oriented—approximately 90 degrees from its position in the forward-facing orientation—and the pin 24 of guide member 26 is moved longitudinally rearward. As a result, the child support's center of gravity ("CG") is moved—longitudinally—a distance "D3" toward the rotation point 6, while remaining laterally aligned with the rotation point 6. Accordingly, when at rest in the right-side-facing orientation shown in FIGS. 15 and 18, the child support's center of gravity remains in alignment with a vertical plane that is perpendicular to the swing path of the swing arm 5 and that extends through the rotation point 6.

According to various embodiments, the repositioning mechanism 20 and child support 10 may be configured in a variety of ways while still retaining the motion characteristics described herein. For example, in certain embodiments the child support 10 comprises a child seat having a rigid shell. In such embodiments, the child seat's shell may be operatively connected to the pins 23, 24 such that the repositioning device 20 permits the child seat to move in the same manner shown in FIGS. 7-12 or FIGS. 13-18. As such, the child seat's shell—rather than, for example, the crossbar 14 of FIGS. 2 and 5—provides a linkage between the pins 23, 24 and the guide members 25, 26. As will be appreciated from the description herein, the repositioning mechanism 20 and/or child support 10 may comprise a variety of linkages, cams, pivots, or the like configured to permit movement of the child support 10 in the manner described herein.

Figure 19A:
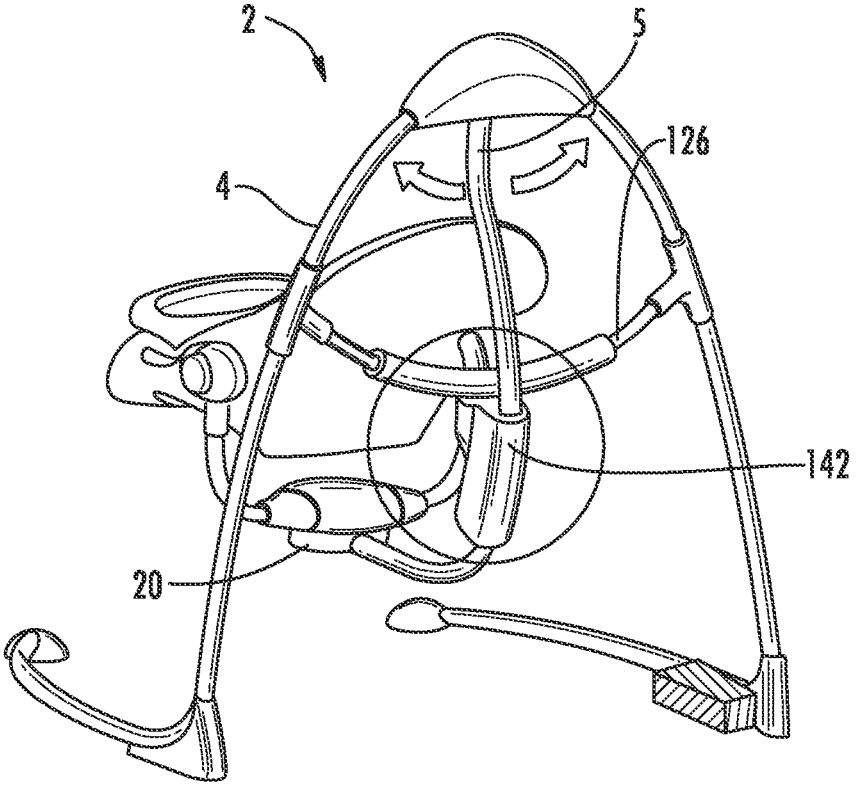
FIGS. 19A-19B show perspective views of a children's swing having an electromagnetic drive system according to one embodiment.
Figure 19B:
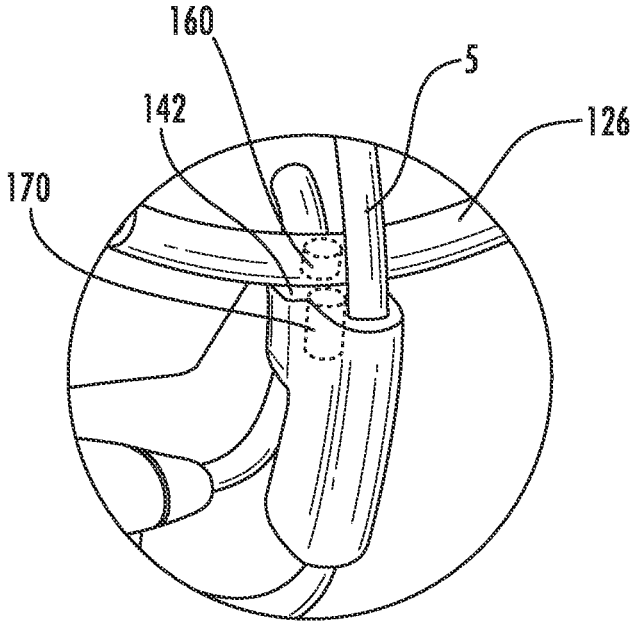

In addition, according to various embodiments, the swing 2 may further include a drive system configured to drive the swing arm 5 and child support 10 along a swing path. For example, in one embodiment, the swing 2 may comprise an electromagnetic drive system such as that described in U.S.

application Ser. No. 12/637,326 entitled "Electromagnetic Swing," filed Dec. 14, 2009, which is herein incorporated in its entirety by reference. FIGS. 19A and 19B illustrate one embodiment in which the swing 2 includes an electromagnetic drive system. In the illustrated embodiment, the drive system comprises a permanent magnet 160 and an electromagnetic coil 170 configured to generate a magnetic force (e.g., repulsive and/or attractive) to drive the swing arm 5. The permanent magnet 160 is positioned within a medial portion of a support member 126 that extends arcuately from one side of the swing frame 4 to an opposite side of the swing frame 4. The electromagnetic coil 170 is positioned within a housing 142 connected to the swing arm 5, and is configured to be in close proximity to the first magnetic component along at least a portion of the swing path.

In the illustrated embodiment of FIGS. 19A and 19B, the electromagnetic drive system operates more efficiently when the permanent magnet 160 and electromagnetic coil 170 are aligned. If the child support's center of gravity becomes misaligned from the rotation point 6, the swing arm 5 would move off-center when at rest and reduce the efficiency of the electromagnetic drive system when beginning to drive the swing arm 5. As a result, the repositioning mechanism 20 permits the electromagnetic drive system to operate at high efficiency by preventing the child support 10 from shifting laterally between any of the forward-facing, left-side-facing, and right-side-facing positions.

CONCLUSION

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A children's swing having a child support configured to move between at least two orientations, said swing comprising:

a swing frame;

at least one swing arm, wherein a rotating end of said swing arm is rotatably connected to said swing frame at a rotation point and said swing arm is configured to reciprocate about said rotation point along a swing path;

a child support configured for receiving and supporting a child; and a repositioning mechanism operatively connected to said swing arm and said child support;

wherein said repositioning mechanism is configured to selectively secure said child support in at least a first orientation and a second orientation;

wherein, when positioned in said first orientation and at rest, said child support faces a direction substantially perpendicular to the direction of said swing path, a target location on said child support is positioned in alignment with a vertical plane that is perpendicular to said swing path and that extends through said rotation point, and said target location on said child support is positioned at a first longitudinal distance from said rotation point; and wherein, when positioned in said second orientation and at rest, said child support faces a direction substantially parallel to the direction of said swing path, said target location on said child support is positioned in alignment with said vertical plane, and said target location on said child support is positioned at a second longitudinal distance from said rotation point, said second longitudinal distance being less than said first longitudinal distance.

2. The children's swing of claim 1, wherein said at least one swing arm comprises multiple swing arms.

3. The children's swing of claim 1, wherein said first orientation is a forward-facing orientation and said second orientation is a side-facing orientation.

4. The children's swing of claim 3, wherein said child support, when positioned in said side-facing orientation, faces a direction approximately 90 degrees from the direction said child support faces when in said forward-facing orientation.

5. The children's swing of claim 3, wherein said side-facing orientation is a left-side-facing orientation and said repositioning mechanism is further configured to selectively secure said child support in a right-side-facing orientation.

6. The children's swing of claim 1, wherein said child support comprises a support frame and a removable cover.

7. The children's swing of claim 1, wherein said child support comprises a child seat.

8. The children's swing of claim 1, wherein:

said child support includes at least two channel engaging members extending downwardly from said child support;

said repositioning mechanism comprises a housing defining at least two intersecting channels dimensioned to receive said channel engaging members; and said channels and said channel engaging members are configured for guiding said child support for movement between said first orientation and said second orientation.

9. The children's swing of claim 1, said swing further comprising a drive system and wherein:

said drive system comprises a first magnetic component operatively connected to the swing frame and a second magnetic component operatively connected to said swing arm, said first magnetic component and said second magnetic components configured to generate magnetic forces to drive said swing arm along said swing path; and said first magnetic component and said second magnetic component remain aligned when said child support is at rest and in said first orientation and when said child support is at rest and in said second orientation.

10. The children's swing of claim 1, wherein said target location on said child support is an approximated location of said child support's center of gravity.

11. The children's swing of claim 1, wherein said target location on said child support is an approximated location of said child support's center of gravity with a child positioned therein.

12. The children's swing of claim 1, wherein said target location is the center of gravity of said child support.

* * * * *